US007100701B2

(12) United States Patent
Sprakel et al.

(10) Patent No.: US 7,100,701 B2
(45) Date of Patent: Sep. 5, 2006

(54) FIRE-FIGHTING DEVICE

(75) Inventors: Dirk Sprakel, Köln (DE); Dirk Laibach, Wuppertal (DE)

(73) Assignee: Fogtec Brandschutz GmbH & Co. KG, Kölln (DE)

( * ) Notice: Subject to any disclaimer, the term of this patent is extended or adjusted under 35 U.S.C. 154(b) by 44 days.

(21) Appl. No.: 10/466,480

(22) PCT Filed: Jan. 14, 2002

(86) PCT No.: PCT/EP02/00270

§ 371 (c)(1),
(2), (4) Date: Jan. 7, 2004

(87) PCT Pub. No.: WO02/055154

PCT Pub. Date: Jul. 18, 2002

(65) Prior Publication Data

US 2004/0123989 A1 Jul. 1, 2004

(30) Foreign Application Priority Data

Jan. 12, 2001 (DE) ..... 101 01 490

(51) Int. Cl.
*A62C 3/07* (2006.01)

(52) U.S. Cl. ..... 169/60; 169/16; 169/56; 169/29; 169/5

(58) Field of Classification Search ..... 169/29, 169/30, 21, 65, 72, 46, 56, 60, 5, 16, 17; 116/270, 272, 102
See application file for complete search history.

(56) References Cited

U.S. PATENT DOCUMENTS

| | | | | | |
|---|---|---|---|---|---|
| 2,132,132 | A | * | 10/1938 | Seat | 137/209 |
| 3,014,206 | A | * | 12/1961 | Slavin | 340/591 |
| 3,109,409 | A | * | 11/1963 | Demay | 116/103 |
| 4,055,844 | A | * | 10/1977 | Hornbostel, Jr. | 340/521 |
| 4,552,221 | A | | 11/1985 | Klein | |
| 4,838,310 | A | * | 6/1989 | Scott et al. | 137/624.14 |
| 4,979,572 | A | * | 12/1990 | Mikulec | 169/65 |

FOREIGN PATENT DOCUMENTS

| | | |
|---|---|---|
| DE | 195 22 495 | 1/1997 |
| DE | 199 30 481 A1 | 1/2001 |
| DE | 199 30 482 A1 | 1/2001 |
| EP | 0 873 766 A2 | 10/1998 |

* cited by examiner

*Primary Examiner*—Dinh Q. Nguyen
(74) *Attorney, Agent, or Firm*—Proskauer Rose LLP

(57) ABSTRACT

The invention relates to an apparatus for fire-fighting comprising a fire-extinguishing nozzle (4) connected to an extinguisher fluid supply (3) via a pipe (2) and comprising an alarm device (5) which delivers a warning signal at the beginning of a fire-extinguishing process. In such an apparatus the risk of leaks occurring is reduced and effective alarming of the surroundings at the beginning of the fire-extinguishing process is ensured according to the invention by the fact that the alarm device (5) comprises a pressure-actuatable switching device connected to the pipe (2) which triggers the warning signal in the event of an increase in the pressure prevailing in the pipe (2).

14 Claims, 2 Drawing Sheets

FIRE-FIGHTING DEVICE

BACKGROUND OF THE INVENTION

The invention relates to an apparatus for fire-fighting comprising a fire-extinguishing nozzle connected to an extinguisher fluid supply via a pipe and comprising an alarm device which delivers a warning signal at the beginning of a fire-extinguishing process. Such apparatus is installed, for example, in fixed positions in buildings or other equipment to be protected from fire. As a rule, there are provided devices which automatically trigger the outflow of extinguisher fluid when a fire occurs.

In many cases, the alarm devices deliver a warning in the form of an acoustic signal perceptible over a fairly large distance when the fire-extinguishing process begins. In this way, it is ensured that also the fire-extinguishing process which begins in an unobserved area and consequently the fire itself is noticed by persons in the vicinity of the affected area.

For this purpose known sprinkler installations are provided with so-called "sprinkler bells", which are driven in the fashion of a turbine by the water flowing through the pipe in the event of a fire. In fire-fighting apparatus in which gaseous media are used as extinguisher fluid, it is also known that some of the gas is passed through a pneumatically operating siren.

The disadvantage of known alarm systems with sprinkler systems in which the alarm device is driven hydraulically by the liquid extinguisher medium is that a drive shaft leading out of the respective pipe must be present. Leaks may occur in the area of this rotary transmission. In addition, the drive mechanism impedes the flow of extinguisher fluid in the pipe. In fire-extinguishing apparatus in which some of the gaseous extinguisher fluid is branched off to drive the alarm device, leaks may also occur. The risk of leaks occurring is particularly high in systems operating at high pressures. Such high pressures are required especially when a liquid extinguisher fluid or a mixture of liquid and gaseous extinguisher media is atomised by the fire-extinguishing nozzles to form a fire-extinguishing mist. With such fire-extinguishing mists a fire can be fought particularly effectively with a low consumption of fire-extinguishing agents.

SUMMARY OF THE INVENTION

The object of the invention is to provide an apparatus for fire-fighting wherein, on the one hand, the risk of leaks occurring is minimised and on the other hand, effective alarming of the surroundings at the beginning of the fire-extinguishing process is ensured.

This object is solved by an apparatus for fire-fighting comprising a nozzle head connected to a supply of extinguisher fluid via a pipe and comprising an alarm device which delivers a warning signal at the beginning of a fire-extinguishing process wherein the alarm device comprises a pressure-actuatable switching device connected to the pipe which triggers an alarm signal in the event of an increase in the pressure prevailing in the pipe.

According to the invention, the extinguisher fluid no longer drives the alarm device but there is used a pressure-sensitive switching device connected to the pipe which recognises the beginning of the fire-extinguishing process by the increase in pressure in the pipe and triggers the warning signal. The connection which exists in the prior art between the pipe and the surroundings via the pipe apertures required for the rotary transmission of the hydraulic drive of the alarm device or for the outflow of extinguisher gas is no longer required in apparatus constructed according to the invention. Thus, in apparatus according to the invention the risk of leaks is also reduced to a minimum.

The construction of a fire-extinguishing apparatus according to the invention can be used both for systems wherein the pipe is filled with extinguisher fluid under a static pressure when the apparatus is at rest and also in such systems where the pipe is dry in the rest state of the apparatus. The pipe can also be charged with a gaseous medium such as air or $N_2$ in the rest state, wherein these media can be pre-stressed under a static pressure in order to improve the reaction times. In all systems of this type the increase in pressure in the pipe accompanying the beginning of the fire-extinguishing process represents a clear criterion for the triggering of the warning signal.

The alarm device can deliver an optical warning signal or an acoustic warning signal. Naturally, these signal forms can also be combined. In this case, the extinguisher fluid flowing in the pipe system can be used to set in vibration an acoustic body or a membrane, without however leaving the pipe system.

A particularly advantageous variant of the invention for practical realisation is characterised in that the switching device has a pressure-receiving element supported on an elastic support and that, in the event of an increase in the pressure prevailing in the pipe, the pressure-receiving element moves against the force of the elastic support from its rest position to its trigger position. With such a switching element hydraulically or pneumatically driven alarm devices can be triggered without any problems. In this case, the elastic support is preferably a spring. With such an elastic means, forces can be generated in a simple fashion even in a confined space, which are sufficient to hold the switching element in the rest state securely in the rest position.

A further particularly favourable embodiment of the invention with respect to the practical application is characterised in that the switching device actuates a signal generating device driven by stored pressure energy. Such a signal-generating device is independent of energy supplies to be supplied externally and as such can be connected without any problems at arbitrary locations in the pipe. It is especially favourable in this regard if, in the event of an increase in pressure, the switching device opens a pressure storage device in which the medium driving the signal-generating device is stored. This pressure storage device independent of the extinguisher fluid supply, supplies the alarm device with the energy needed to deliver the warning signal so that the alarm device with the pressure element and the pressure storage device forms a completely closed system towards the surroundings. This can be accomplished in a simple fashion especially if the pressure storage device in the rest state is provided with a cover which the pressure element pierces in the course of its movement from the rest position to the trigger position. This cover is preferably constructed in the form of a rupture disk which only ruptures at a pre-determined pressure. In this way, it can easily be ensured that the alarm device is not triggered by a movement of the pressure element caused as a consequence of an unintentional pressure surge in the pipe which remains below a certain trigger pressure.

A further advantageous variant of the invention which assumes the existence of a stored pressure energy which is released from the respective pressure storage device in the event of an increase in pressure is characterised in that the medium which flows out when the pressure storage device is opened, drives a device for generating electrical energy.

Such a hydraulically or pneumatically driven device then as a generator delivers the electrical energy for the operation of an electrically operated signal device. In this fashion the advantages of electrically operated warning devices such as, for example, the simple generation of light signals or the output of specific electrically generated sounds can be used without the need to install expensive cabling which is susceptible to failure.

The invention can be used especially favourably in such apparatus wherein in the case of a fire, extinguisher fluid flows through the pipe at a high pressure over 10 bar, preferably over 70 bar. In this case, the suitability of the invention is independent of whether the extinguisher fluid is conveyed to the nozzle by means of stored pressure energy or by pumping, wherein, as a result of the circumstance that no external electrical energy is required for its function, the invention can be used especially favourably in connection with fire-extinguishing systems wherein the extinguisher fluid is available under pressure in pressure storage devices for the case of a fire.

BRIEF DESCRIPTION OF THE DRAWINGS

The invention is explained in detail below with reference to a drawing showing an exemplary embodiment. In the figures, which each show a cutaway partial view in longitudinal cross-section.

DETAILED DESCRIPTION OF THE INVENTION

Figure 1:
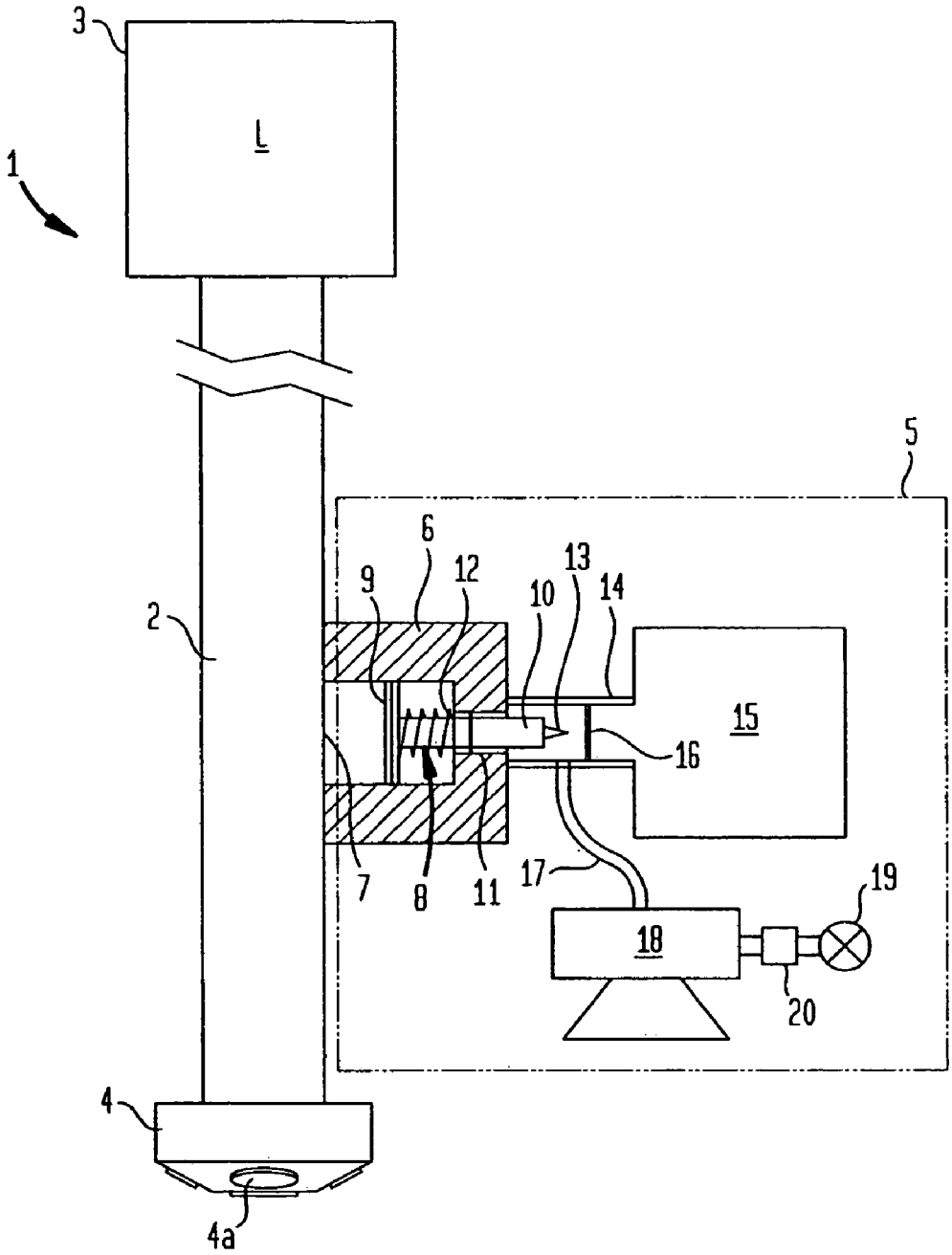
FIG. 1 shows an apparatus for fire-fighting in the rest position.

The apparatus 1 comprises a pipe 2 made of a flexible, hose-like or rigid material, which connects a pressure storage device 3 to a nozzle head 4. In the pressure storage device 3 which is independent of electrical energy, water, for example, is stored as extinguisher fluid L. Alternatively, in the case of a fire the apparatus 1 can also be supplied with fire extinguishing water via a pump not shown.

The nozzle head 4 is equipped with fire-extinguishing nozzles 4*a* which atomise the extinguisher fluid into a finely distributed fire-extinguishing mist during a fire-extinguishing process.

An alarm device 5 is connected to the pipe 2 adjacent to the nozzle head 4. The alarm device 5 comprises a housing 6 whose interior is connected via a connecting aperture 7 to the interior of the pipe 2. Guided in the housing 6 as a pressure element is a piston 8 which piston 8 has an enlarged pressure plate 9 on its side facing the connecting aperture 7. The pressure plate 9 abuts tightly against the side walls of the housing 6 with its side surfaces. Formed onto the pressure plate 9 on its side facing away from the connecting aperture 7 is a pin-shaped guide element 10 of the piston 8 which is guided through a guide opening 11 at the bottom of the housing 6. At the same time, the piston 8 is supported elastically on the bottom of the housing 6 via a spiral spring 12 arranged coaxially to the guide element 10. At its free end which projects from the guide opening 11 the guide element 10 has a tip 13.

A pressure bottle 15 in which a gaseous medium, for example, air is stored under pressure, is attached opposite the guide opening 11 and at a certain distance therefrom via a sleeve 14 which surrounds the guide opening 11 and is connected tightly to the housing 6. The sleeve 14 also holds the head of the pressure bottle 15 tightly enclosed. The opening in the pressure bottle 15 opposite the guide opening 11 is tightly sealed in the rest state by means of a bursting disk 16.

A pneumatically operated siren 18 is connected to the interior of the sleeve 14 via a hose connection 17. Further, an optical alarm 19 is attached to the siren 18. A device 20 generates electrical energy for operating optical alarm 19.

In the rest state the pipe 2 can be filled with extinguisher fluid at a static pressure. This has the advantage that leaks which become noticeable as a result of a pressure drop in the pipe 2 can be quickly identified. In exactly the same way, however, in the rest state the pipe 2 can also be dry or pre-stressed with a pressurised gaseous medium such as compressed air or nitrogen.

Figure 2:
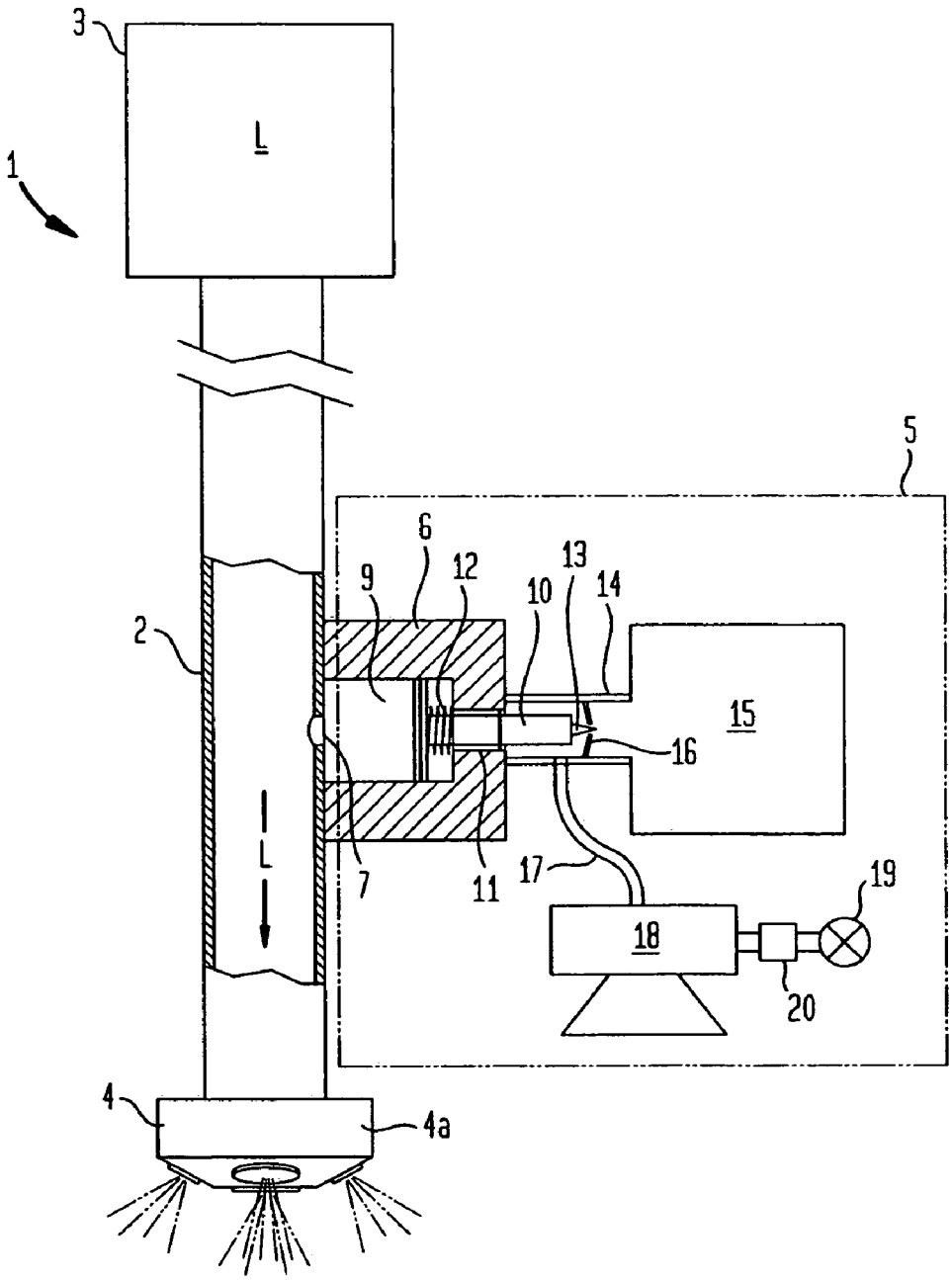
FIG. 2 shows the apparatus according to FIG. 1 during a fire-extinguishing process.

In the event of a fire, the effluence of extinguisher fluid is triggered, for example, by a fire control not shown, arranged on the nozzle head 4. The pipe 2 is thereupon supplied with extinguisher fluid L at elevated pressure from the pressure storage device 3 (FIG. 2). As a result of the accompanying increase in the pressure in the pipe 2, the piston 8 is moved against the force of the spring 12 in the direction of the bursting disk 16. The tip 13 is moved in this fashion over the distance which exists between it and the bursting disk 16 in the rest state until it sits on the bursting disk 16. If the pressure in the pipe 2 and along with this the pressure exerted by the tip 13 on the bursting disk 16 exceeds a certain minimum value, the bursting disk 16 ruptures and exposes the opening of the pressure bottle 15.

The gaseous medium stored in the pressure bottle 15 thereupon flows through the hose pipe 17 to the siren 18 which, driven by the gaseous medium, delivers an acoustic warning signal. Further, the optical alarm 19 can be activated.

REFERENCE LIST

1 Apparatus
2 Pipe
3 Pressure storage device
4 Nozzle head
L Extinguisher fluid
5 Fire-extinguishing nozzles
6 Housing
7 Connecting aperture
8 Piston
9 Pressure plate
10 Guide element
11 Guide opening
12 Spiral spring
13 Tip
14 Sleeve
15 Pressure bottle
16 Bursting disk
17 Hose connection
18 Siren

The invention claimed is:

1. An apparatus for fire-fighting comprising a fire extinguishing nozzle connected to an extinguisher fluid supply via a pipe and comprising an alarm device which delivers a warning signal at the beginning of a fire-extinguishing process, wherein said alarm device is driven independently of the extinguisher fluid and comprises a pressure-actuable switching device connected to said pipe which triggers the delivery of a warning signal in the event of an increase in pressure prevailing inside the pipe, wherein the increased pressure of the extinguisher fluid triggers said alarm device, and wherein the switching device comprises a signal generating device which is driven by stored pressure energy.

2. The apparatus according to claim 1, wherein in the rest state of said apparatus said pipe is filled with an extinguisher fluid at a static pressure.

3. The apparatus according to claim 1, wherein in the rest state said pipe is dry.

4. The apparatus according to claim 1, wherein said pipe is filled with a gaseous medium.

5. The apparatus according to claim 1, wherein said alarm device comprises a device for generating an optical alarm signal.

6. The apparatus according to claim 1, wherein said alarm device delivers an acoustical alarm signal.

7. The apparatus according to claim 1, wherein said switching device has a pressure-receiving element supported on an elastic support and in the event of an increase in the pressure prevailing in said pipe, said pressure-receiving element moves against the force of the elastic support from its rest position in its trigger position.

8. The apparatus according to claim 7, wherein in the event of an increase in pressure, said switching device opens a pressure storage device in which the medium driving said signal generating device is stored.

9. The apparatus according to claim 8, wherein when said pressure storage device is open, the medium flowing out of said pressure storage device drives a device for generating electrical energy.

10. The apparatus according to claim 9, wherein a signal generating device is connected to said device for generating electrical energy.

11. The apparatus according to claim 1, wherein in the rest state said pressure storage device is provided with a cover which the pressure element ruptures in the course of its movement from the rest position into the trigger position.

12. The apparatus according to claim 11, wherein said cover is a bursting disk which ruptures at a pre-determined pressure.

13. The apparatus according to claim 1, wherein in case of a fire, extinguisher fluid flows through said pipe at a pressure over 10 bar.

14. The apparatus according to claim 1, wherein in case of a fire, extinguisher fluid flows through said pipe at a pressure over 70 bar.

* * * * *